US008597086B2

(12) United States Patent
Noro et al.

(10) Patent No.: US 8,597,086 B2
(45) Date of Patent: Dec. 3, 2013

(54) TOOL HOLDER

(75) Inventors: Daisuke Noro, Tochigi (JP); Hiroaki Koyama, Tochigi (JP); Kenji Sugai, Tochigi (JP); Hiroaki Yoshikawa, Tochigi (JP); Satoshi Mitsuyose, Tochigi (JP); Takefumi Mizuhori, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 459 days.

(21) Appl. No.: 12/831,698

(22) Filed: Jul. 7, 2010

(65) Prior Publication Data

US 2011/0014854 A1 Jan. 20, 2011

(30) Foreign Application Priority Data

Jul. 17, 2009 (JP) ..... P.2009-168513

(51) Int. Cl.
*B24B 33/08* (2006.01)

(52) U.S. Cl.
USPC ..... 451/478; 451/470; 451/481

(58) Field of Classification Search
USPC ..... 451/504, 505, 61, 478, 464, 476, 449, 451/470, 151, 481; 138/43, 45, 46
See application file for complete search history.

(56) References Cited

U.S. PATENT DOCUMENTS 1,690,033 A * 10/1928 Noble ..... 137/198
1,830,928 A * 11/1931 Campbell et al. ..... 137/338
1,850,847 A * 3/1932 O'Brien ..... 451/478
1,919,408 A * 7/1933 Work ..... 138/40
2,032,122 A * 2/1936 Farmer ..... 137/338
2,257,474 A * 9/1941 McKeen ..... 451/481
2,284,325 A * 5/1942 Kline ..... 451/151
2,312,012 A * 2/1943 Wallace ..... 451/481
2,312,013 A * 2/1943 Wallace ..... 451/481
2,403,546 A * 7/1946 Olsen ..... 451/481
2,450,294 A * 9/1948 Palotsee ..... 451/481
2,596,961 A * 5/1952 Smole ..... 451/470
2,688,219 A * 9/1954 Taylor ..... 451/478
2,777,257 A * 1/1957 Johnson ..... 451/151
2,813,383 A * 11/1957 La Jeunesse ..... 451/478
3,232,011 A * 2/1966 Pineau ..... 451/505

(Continued)

FOREIGN PATENT DOCUMENTS

CN 1824873 A 8/2006
DE 3336626 A1 * 4/1985

(Continued)

*Primary Examiner* — Lee D Wilson
*Assistant Examiner* — Joel Crandall
(74) *Attorney, Agent, or Firm* — Arent Fox LLP

(57) ABSTRACT

A tool holder is provided with a main body, a taper cone, a working portion, a coolant flow passage, and an adjuster. The taper cone includes a taper portion and movable in an axial direction of the main body. The working portion is mounted on an outer peripheral portion of the main body and includes a taper bottom surface which engages with the taper portion. The taper bottom surface is movable in a radial direction of the main body based on a movement of the taper cone in the axial direction. A coolant flows through the coolant flow passage such that a part of the coolant presses and moves the taper cone in the axial direction and another part of the coolant flows out to an outside so as to adjust a pressing force. The adjuster is fitted into a hole penetrating the main body and includes a coolant flow-out hole for adjusting a flow-out of the coolant.

9 Claims, 5 Drawing Sheets

(56) References Cited

U.S. PATENT DOCUMENTS

| | | | | | |
|---|---|---|---|---|---|
| 3,446,377 | A | * | 5/1969 | Heinert | 414/408 |
| 3,619,956 | A | * | 11/1971 | Gehring | 451/481 |
| 3,707,810 | A | * | 1/1973 | Grosseau | 451/478 |
| 3,710,518 | A | * | 1/1973 | Grosseau | 451/470 |
| 3,861,091 | A | * | 1/1975 | McDonald | 451/476 |
| 3,987,591 | A | * | 10/1976 | Czubak | 451/478 |
| 4,434,588 | A | * | 3/1984 | Wada et al. | 451/476 |
| 4,677,792 | A | * | 7/1987 | Speidel | 451/342 |
| 4,877,055 | A | * | 10/1989 | Knuchel et al. | 137/565.34 |
| 5,085,014 | A | * | 2/1992 | Sandhof | 451/51 |
| 5,244,322 | A | * | 9/1993 | Schweizer et al. | 409/233 |
| 6,106,383 | A | * | 8/2000 | Kalokhe et al. | 451/470 |
| 6,425,808 | B1 | * | 7/2002 | Higashikawa | 451/180 |
| 6,739,949 | B2 | * | 5/2004 | Becksvoort et al. | 451/470 |
| 7,694,377 | B2 | * | 4/2010 | Bourrelly | 15/104.095 |
| 2002/0070052 | A1 | * | 6/2002 | Armell et al. | 175/273 |
| 2009/0129879 | A1 | * | 5/2009 | Sadaoka et al. | 408/1 R |

FOREIGN PATENT DOCUMENTS

| | | | | |
|---|---|---|---|---|
| DE | 4020097 | C1 | * | 2/1991 |
| JP | 01078755 | A | * | 3/1989 |
| JP | 2106267 | A | | 4/1990 |
| JP | 7-4759 | B2 | | 1/1995 |

* cited by examiner

| DIAMETER DIMENSION | GRINDING DIAMETER |
|---|---|
| d1 | D1 |
| d2 | D2 |
| d3 | D3 |
| d1<d2<d3 | D1>D2>D3 |

TOOL HOLDER

BACKGROUND OF THE INVENTION

1. Field of the Invention

The present invention relates to a tool holder used in a honing operation for grinding and finishing an inner surface of a hole formed in a workpiece with high precision. Specifically, the invention relates to a tool holder which allows a general-purpose machine tool to carry out multiple honing operations.

2. Related Art

Conventionally, a tool holder is used for a honing operation. The tool holder includes, on a leading end portion thereof, grinding shoes with their associated slender grindstones. Hereinafter, such tool holder is referred to as a honing holder. The honing holder, generally, is mounted on a main spindle of a honing machine. In a state where a grindstone is in surface contact with an inner surface of the hole of a workpiece, the honing holder is rotated and simultaneously reciprocated in an axial direction thereof by the honing machine, so as to minutely cut or abrasively finish the inner surface of the hole of the workpiece.

In such honing operation, in order to cool heat generated by grinding and also to wash away honed dust and grindstone grinding dust to thereby facilitate the honing operation, generally, a coolant (a cooling solution) is continuously sprayed onto a grinding portion.

Further, in order to be able to press the grindstones against the inner surfaces of the holes of the workpiece, generally, there is employed a structure in which a push rod including a taper portion (which is hereinafter referred to as a taper cone) is moved in the axial direction to push out the respective grinding shoes in the radial direction, thereby expanding all of the grindstones uniformly in a radial direction. That is, suppose a circle which has a radius constituted of a length extending from the axis of the honing holder to the grindstone, in the case that the respective grinding shoes are pushed out in the radial direction due to the movement of the taper cone in the axial direction, the diameter of this circle (which is hereinafter referred to as a grinding diameter) is expanded. Such expansion of the grinding diameter is generally realized by adjusting the pressure force of the taper cone using an oil pressure control function of the honing machine.

Recently, there has been made a request that such honing operation is carried out using a general-purpose machine tool not a special machine tool, that is, a honing machine. However, since the general-purpose machine tool, in many cases, does not have an oil pressure control function, in order to meet the above request, as a method for adjusting the pressure force of the taper cone, there is necessary a different method from the oil pressure control method. JP-B-07-004759 discloses an adjusting method using a coolant supply mechanism provided in the general-purpose machine tool. In the method, the pressure force of the taper cone is adjusted by controlling a supply pressure of a coolant.

However, since a coolant supply pump of the general-purpose machine tool is normally operated with a given pressure. Therefore, if the supply pressure of the coolant is changed, there can be raised a trouble in the coolant supply mechanism. Thus, the coolant supply mechanism of the general-purpose machine tool must be presupposed that the supply pressure of the coolant is constant or that, even if variable, it can be switched only roughly in several stages by opening and closing a valve.

Therefore, even when the method of JP-B-07-004759 is applied to a honing operation using the general-purpose machine tool under the above presupposition, it is impossible to finely adjust the pressure force of the taper cone. As a result, a grinding diameter to be expanded can not be varied so that a given fixed diameter can only be selected.

This raises the following problem. That is, for example, if multiple honing operations are carried out in stages from a rough finishing operation to a precision finishing, the grinding diameter should be changed whenever the respective honing operations are carried out, or, even when the grinding diameter remains the same, the proper surface pressures of the grindstones with respect to the hole inner surfaces of the workpiece should be varied. This makes it necessary to prepare a special honing holder for each of the multiple honing operations. This raises a problem that a cost of the tool holder is expensive. Also, it becomes necessary to replace a honing holder before and after each honing operation. This raises a problem that an operator must bear an excessive operation burden.

SUMMARY OF THE INVENTION

One or more embodiments of the invention provide a low cost tool holder which can carry out multiple honing operations in a general-purpose machine tool, while reducing an operation burden of an operator in each honing operation.

In accordance with one or more embodiments of the invention, a tool holder (for example, a honing holder 1 in the exemplary embodiment) is provided with: a main body (for example, a main body 11 in the exemplary embodiment) which includes two end portions in an axial direction thereof and one (for example, a base end portion 11*b* in the exemplary embodiment) of the two end portions of which is attached to a spindle rotatable by driving means; a taper cone (for example, a taper cone 17 in the exemplary embodiment) which includes taper portions (for example, taper portions 17*b* and 17*c*) and also which can be moved in the axial direction within the main body; multiple working portions (for example, grinding shoes 13 in the exemplary embodiment) respectively including taper bottom surfaces (for example, taper bottom surfaces 13*b* and 13*c* in the exemplary embodiment) which are engaged with the taper portions of the taper cone when the multiple working portions are removably mounted on an outer peripheral portion of the other (for example, the leading end portion 11*t* in the exemplary embodiment) of the two end portions of the main body, while the taper bottom surfaces engaged with the taper portions of the taper cone can be moved in a radial direction of the main body due to a movement of the taper cone in the axial direction; a coolant flow passage (for example, a coolant flow passage 16 in the exemplary embodiment) trough which a coolant flows in such a manner that, in order to move the taper cone in the axial direction, at least a part of the coolant presses the taper cone in the axial direction and, in order to be able to adjust a pressing force of the taper cone, a remaining part of the coolant flows out to an outside; and, a screw-like adjuster (for example, a coolant flow-out adjuster 15 in the exemplary embodiment) which can be removably fitted into a screw hole penetrating through the coolant flow passage and an outer periphery of the main body and also which includes a coolant flow-out hole (for example, a coolant flow-out hole 41 in the exemplary embodiment) for limiting a flow-out of the coolant to the outside.

According to this structure, the coolant flow passage is set such that, in order to move the taper cone in the axial direction of the main body, at least the part of the coolant presses the taper cone in the axial direction and, in order to be able to adjust the pressing force of the taper cone, the remaining part of the coolant flows out to the outside. Also, there is provided the screw-like adjuster which can be removably fitted into the screw hole penetrating through the coolant flow passage and the outer periphery of the main body and also which includes the coolant flow-out hole for limiting the flow-out of the coolant to the outside. Owing to this, an adjustment of the pressing force of the taper cone can be realized not by controlling a supply pressure of the coolant but by limiting the flow-out of the coolant to the outside based on a diameter dimension of the coolant flow-out hole. Therefore, for example, if multiple screw-like adjusters different from each other in the diameter dimensions of the coolant flow-out holes are prepared in order to carry out multiple honing operations in a general-purpose machine tool having a constant coolant supply pressure, an operator can easily adjust the pressing force of the taper cone by simply selecting a proper one from among the multiple screw-like adjusters and fitting the selected adjuster into the screw hole of the main body. As a result, a grinding diameter can be expanded to a desired diameter and also a surface pressure of a grindstone against an inner surface of a hole of a workpiece can be maintained at a proper pressure. Thus, when compared with a conventional honing operation in which a whole of the tool holder must be replaced, according to the structure of the embodiments, by only replacing the screw-like adjuster which is a part of the tool holder, an operation burden of an operator can be reduced. Also, when compared with a conventional technology in which there must be prepared multiple tool holders, according to the structure of the embodiments, only by preparing the multiple screw-like adjusters which are a part of the tool holder, a cost of the tool holder can be reduced.

Further, there may be provided the above-mentioned multiple screw-like adjusters differing from each other in the diameter dimensions of the coolant flow-out holes.

The embodiments of the invention also provides a method of adjusting a grinding diameter of a tool holder 1 including a main body 11, a taper cone 17 accommodated within the main body 11, a working portion 13, and a coolant flow passage 16. In accordance with the embodiments, the method includes the steps of: selecting one adjuster 15 from a plurality of adjusters 15, the plurality of adjusters 15 respectively including coolant flow-out holes 41 and diameters of the coolant flow-out holes 41 being different depending on the adjusters 15; fitting the selected adjuster 15 into a screw hole penetrating from the coolant flow passage 16 to an outer periphery of the main body 11; feeding a coolant to the coolant flow passage 16 such that a part of the coolant presses and moves the taper cone 17 in an axial direction of the main body 11 and another part of the coolant flows out to an outside through the coolant flow-out hole 41 of the selected adjuster 15 so as to adjust a pressing force; and moving the working portion 13 in a radial direction of the main body 11 due to a movement of the taper cone 17 in the axial direction.

According to the embodiments, the adjustment of the pressing force of the taper cone can be made not by controlling the supply pressure of the coolant but by replacing the screw-like adjusters. Also, for example, if the correspondence relationship between the grinding diameter and the diameter dimension of the flow-out hole of the coolant is previously set (for example, standardized) on the assumption that the supply pressure of the coolant is constant, based on the correspondence relationship (standard), multiple screw-like adjusters differing from each other in the diameter dimensions of the coolant flow-out holes can be easily prepared at a low cost.

According to the embodiments, the adjustment of the pressing force of the taper cone can be realized not by controlling the supply pressure of the coolant but by adjusting the flow-out of the coolant to the outside based on the diameter dimension of the coolant flow-out hole. Therefore, for example, if multiple screw-like adjusters different from each other in the diameter dimensions of the coolant flow-out holes are prepared in order to carry out multiple honing operations in the general-purpose machine tool having a constant coolant supply pressure, an operator can easily adjust the pressing force of the taper cone by simply selecting a proper one from among the multiple screw-like adjusters and fitting it into the screw hole of the main body. As a result, the grinding diameter can be expanded to a desired diameter and also the surface pressure of the grindstone against the inner surface of the hole of the workpiece can be maintained properly. Thus, when compared with a conventional operation in which the whole of the tool holder must be replaced, according to the embodiments, only the screw-like adjusters, each of which is a part of the tool holder, may be replaced, thereby being able to reduce the operation burden of the operator. Also, when compared with a conventional technology in which there must be prepared multiple tool holders, according to the embodiments, only the multiple screw-like adjusters, which are a part of the tool holder, may be prepared, thereby being able to reduce the cost of the tool holder.

Other aspects and advantages of the invention will be apparent from the following description and the appended claims.

DETAILED DESCRIPTION OF THE EXEMPLARY EMBODIMENTS

An exemplary embodiment of the invention is described with reference to the accompanying drawings.

Figure 1:
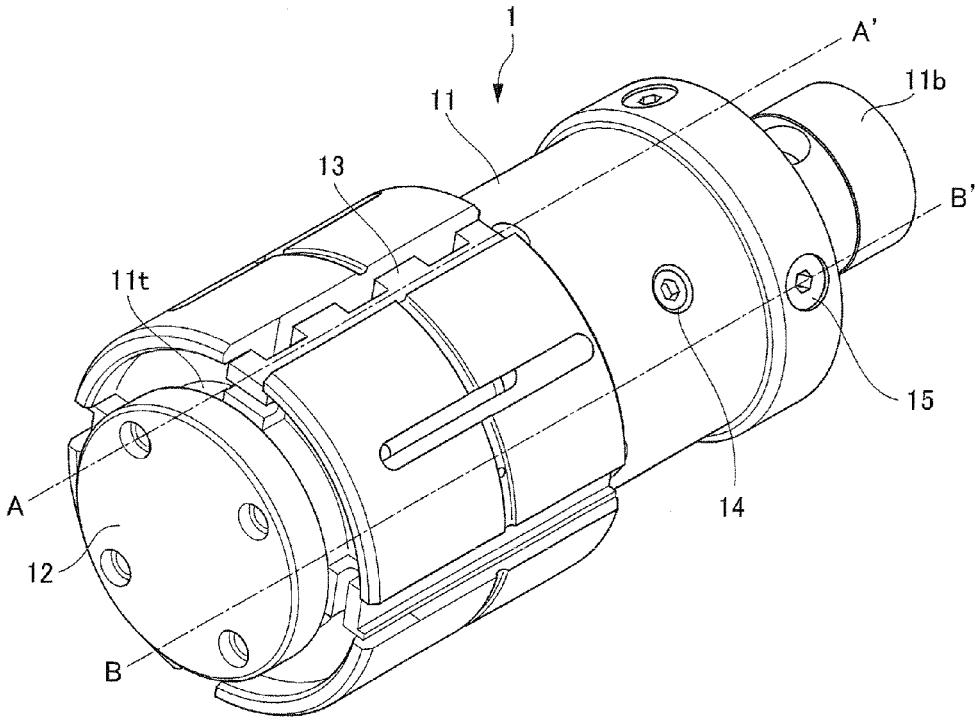
FIG. 1 is a perspective view of a schematic structure of a honing holder according to an exemplary embodiment.
Figure 2:
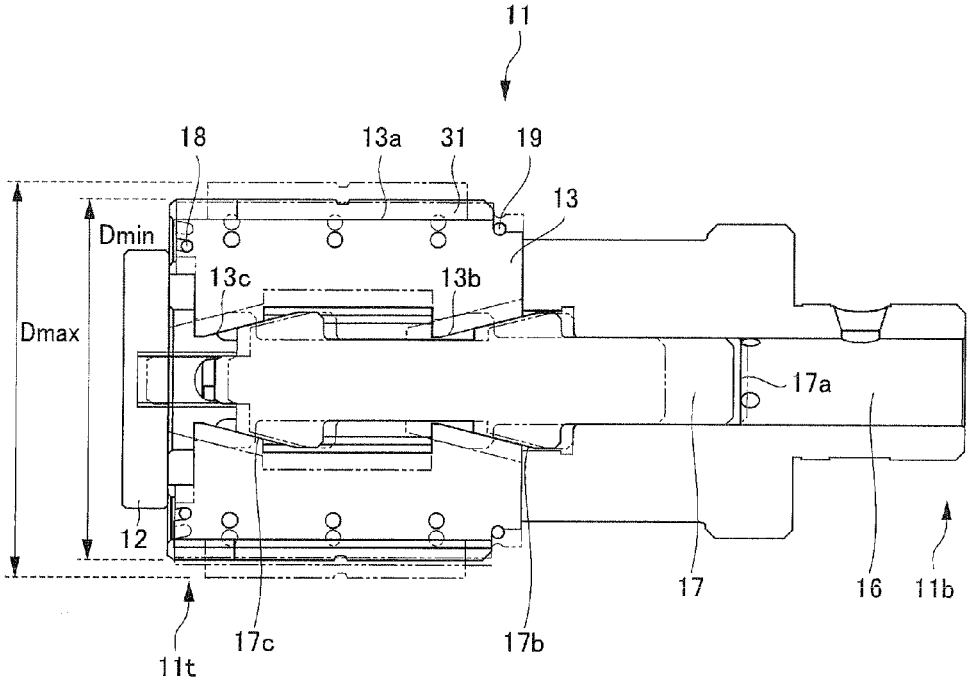
FIG. 2 is a section view of the honing holder of the exemplary embodiment.
Figure 3:
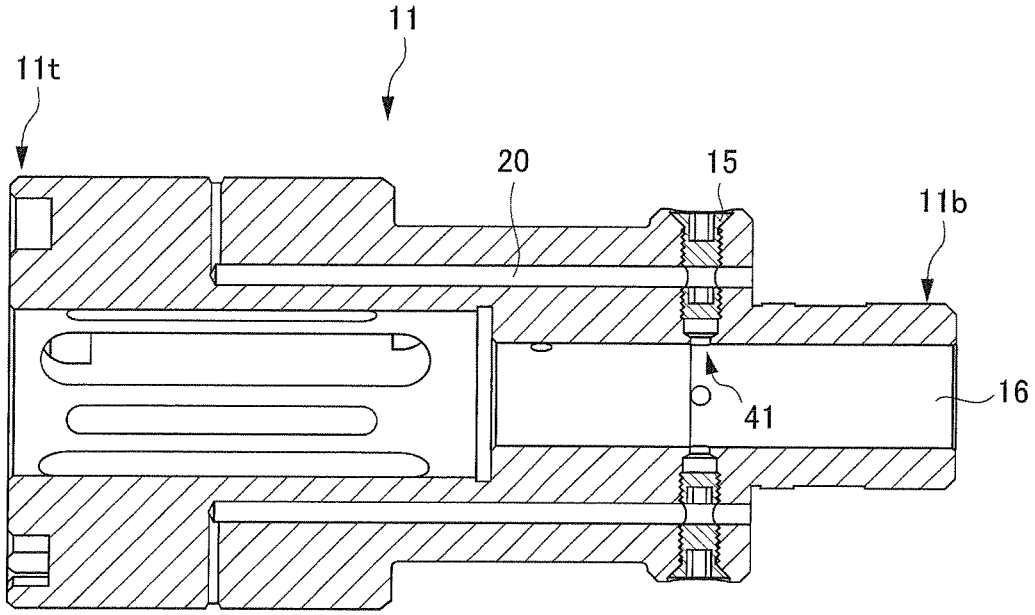
FIG. 3 is a section view of the honing holder of the exemplary embodiment.

FIG. 1 is a perspective view to a schematic structure of a honing holder 1 according to an exemplary embodiment of the invention. FIG. 2 is a section view of the honing holder 1, taken along A-A' line in FIG. 1. FIG. 3 is a section view of the honing holder 1, taken along B-B' line in FIG. 1.

As shown in FIGS. 1 to 3, the honing holder 1 for use in a honing operation includes a main body 11, an end cap 12, a grinding shoe 13, a fixing screw 14, a screw-like adjuster 15, a coolant flow passage 16, a taper cone 17, springs 18 and 19, and a coolant discharge passage 20.

The main body 11 includes a leading end portion 11*t* and a base end portion 11*b* each having a substantially cylindrical shape. The leading end portion 11*t* and the base end portions 11*b* respectively extend in a direction of an axis (a line which extends parallel to the A-A' line and B-B' line shown in FIG. 1 and passes through a center of the main body) of the main body 11.

The base end portion 11*b* of the main body 11 is attached to a spindle which can be rotated by driving means (not shown). Here, as the driving means, there may be employed a special-purpose machine tool, that is, a honing machine, or there may also be employed a general-purpose machine tool. For example, according to the exemplary embodiment, there is employed the general-purpose machine tool (not shown) as the driving means.

On the other hand, on the leading end portion 11*t* of the main body 11, the end cap 12 which is formed to have a substantially cylindrical shape is mounted.

As shown in FIGS. 2 and 3, the coolant flow passage 16 is formed in a central inside portion of the main body 11. The coolant flow passage 16 penetrates through the central inside portion from the base end portion 11*b* to the leading end portion 11*t*. A member configuring the coolant flow passage 16 is fixed to the central inside portion of the main body 11 by a fixing screw 14 shown in FIG. 1.

The taper cone 17 is accommodated within the coolant flow passage 16. The taper cone 17 can move in the axial direction of the main body 11. The taper cone 17 includes a pressing portion 17*a* and two taper portions 17*b*, 17*c* both of which are inclined in the axial direction of the main body 11.

The grinding shoes 13 are mounted on the main body 11. A grindstone 31 is mounted on an upper surface 13*a* of each of the grinding shoes 13. Each of the grinding shoes 13 is detachably mounted onto a recessed portion formed in an outer peripheral portion of the leading end portion 11*t* of the main body 11. For example, according to the exemplary embodiment, as shown in FIG. 1, four recessed portions are formed in the outer peripheral portion of the leading end portion 11*t* at regular intervals in a peripheral direction of the leading end portion 11*t*. That is, four grinding shoes 13 are mounted into the four recessed portions, such that they are detachable in the radial direction of the main body 11, according to the exemplary embodiment. Further, the number of grinding shoes 13 is not limited to four as shown in FIG. 1 but any number can be employed, provided that it is two or more.

The grinding shoe 13 includes two taper bottom surfaces 13*b* and 13*c* respectively formed in the bottom portion thereof. In the case that the grinding shoe 13 is mounted onto the recessed portion of the leading end portion 11*t*, the taper bottom surfaces 13*b* and 13*c* are slidably engaged with the taper portions 17*b* and 17*c* of the taper cone 17 respectively.

Figure 4:
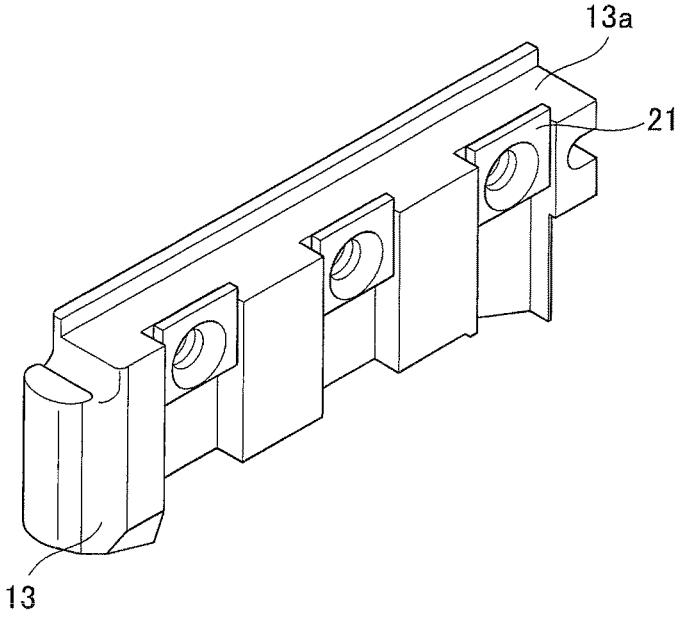
FIG. 4 is a perspective view of a schematic structure of a grinding shoe provided in the honing holder of the exemplary embodiment.

FIG. 4 is a perspective view of the schematic structure of the grinding shoe 13.

The grinding shoe 13 includes a clamp 21. When a screw (not shown) is fastened to the recessed portion side surface of the leading end portion 11*t* through the clamp 21, the grinding shoe 13 is mounted onto the recessed portion of the leading end portion 11*t*. Also, by loosening the screw, the grinding shoe 13 can be removed from the recessed portion of the leading end portion 11*t*.

As shown in FIG. 2, in such portion of the leading end portion 11*t* of the main body 11 as exists around the grindstone 31, springs 18 and 19 are provided. The springs 18 and 19 are respectively used to energize the grindstone 31 and grinding shoe 13 inwardly in the radial direction of the main body 11 (that is, a direction extending toward a rotating axis of the main body 11).

Figure 5:
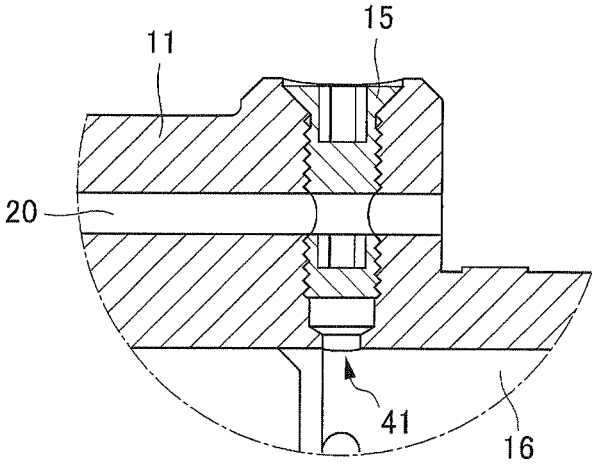
FIG. 5 is an enlarged view of the peripheral portion of a screw-like adjuster shown in FIG. 3.

FIG. 5 is an enlarged view of the peripheral portion of the screw-like adjuster 15 shown in FIG. 3. The screw-like adjuster 15 can be removably fitted into a screw hole which is formed such that it penetrates from the coolant flow passage 16 to an outer periphery of the main body 11. A coolant flow-out hole 41 is formed in the screw-like adjuster 15. When the screw-like adjuster 15 is fitted into the screw hole, the coolant flow-out hole 41 penetrates through the coolant flow passage 16 and coolant discharge passage 20.

As shown in FIG. 3, the coolant discharge passage 20 is formed in the following manner. That is, it penetrates through the inside portion of the main body 11 in the axial direction by a given distance through the coolant flow-out hole 41 of the screw-like adjuster 15 fitted into the screw hole; and then, it turns toward the outside in the radial direction (that is, toward the outer periphery of the main body 11) until it penetrates through the main body 11 up to the outer periphery of the main body 11.

Therefore, a part of the coolant flowing through the coolant flow passage 16 flows out to the outside through the coolant flow-out hole 41 of the screw-like adjuster 15 and coolant discharge passage 20.

Here, the flow-out quantity of the coolant to the outside varies according to the diameter dimension (the area of the opening) of the coolant flow-out hole 41. That is, the coolant flow-out hole 41 has a function to limit and adjust a flow-out of the coolant to an outside in correspondence to a diameter dimension thereof.

Further, according to the exemplary embodiment, four sets of the screw-like adjuster 15 and coolant discharge passage 20 are arranged at regular intervals within the main body 11 in the peripheral direction thereof. However, the number of sets of the screw-like adjuster 15 and coolant discharge passage 20 is not limited to four as in the example shown in FIG. 1.

Next, description will be given below of the operation of the above-structured honing holder 1.

In a honing operation, the base end portion 11*b* of the main body 11 of the honing holder 1 is mounted onto a spindle which can be rotated by a general-purpose machine tool. During mounting the honing holder 1 to the machine tool, since the machine tool stops the supply of the coolant, the springs 18 and 19 respectively energize the grindstone 31 and grinding shoe 13 inwardly in the radial direction. As a result, the grinding shoe 13 holding the grindstone 31 is moved inwardly in the radial direction and is stored into the recessed portion of the leading end portion 11*t* of the main body 11. That is, the grinding shoe 13 is held at a position where the grindstone 31 is not contacted with the inner surface of the hole of a workpiece. Also, as the grinding shoe 13 moves inwardly in the radial direction, the taper cone 17 including the taper portions 17*b* and 17*c* respectively engaged with the taper bottom surfaces 13*b* and 13*c* of the grinding shoe 13 are moved toward the base end portion 11*b* within the main body 11.

Then, when the leading end portion 11*t* of the main body 11 is inserted into the inner surface of the hole of the workpiece, the general-purpose machine tool starts to supply the coolant to the coolant flow passage 16.

A part of the coolant flowing through the coolant flow passage 16 is supplied to the pressing portion 17*a* of the taper cane 17, while a remaining part of the coolant is allowed to flow out to the outside through the flow-out hole 41 of the screw-like adjuster 15 and coolant discharge passage 20. Due to the coolant that is supplied to the pressing portion 17*a*, the taper cone 17 is pressed toward the leading end portion 11*t*, with the result that the taper cone 17 is moved toward the leading end portion 11*t*. With the movement of the taper cone 17 toward the leading end portion 11*t*, the grinding shoe 13 including the taper bottom surfaces 13*b* and 13*c* respectively engaged with the taper portions 17*b* and 17*c* of the taper cone 17 is moved outwardly in the radial direction. As a result, the grindstone 31 held by the grinding shoe 13 is projected out from the outer peripheral portion of the leading end portion 11*t* of the main body 11 and is then pressed against the inner surface of the hole of the workpiece.

In this state, the general-purpose machine tool rotates the spindle and, at the same time, reciprocates it in the axial direction of the main body 11. As a result, the inner surface of the hole of the workpiece is ground by the grindstone 31 held by the honing holder 1.

In such grinding state of the inner surface of the hole of the workpiece, since the flow quantity of the coolant be supplied to the pressing portion 17*a* of the taper cone 17 and the flow quantity of the coolant flowing out to the outside through the coolant flow-out hole 41 of the screw-like adjuster 15 are maintained at proper levels respectively, the pressing force of the taper cone 17 is also maintained at proper level, with the result that the surface pressure of the grindstone 31 against the inner surface of the hole of the workpiece can be maintained at a proper pressure.

That is, according to the exemplary embodiment, the honing operation is carried out in this manner.

Thus, as a part of the coolant is supplied to the pressing portion 17*a* of the taper cone 17, the taper cone 17 is pressed toward the leading end portion 11*t* to thereby expand the grinding diameter (the diameter of a circle the radius of which is the distance from the axis of the leading end portion 11*t* to the surface of the grindstone 31). Here, the expansion range of the grinding diameter, according to the exemplary embodiment, as shown in FIG. 2, is the range that extends from the minimum diameter Dmin to the maximum diameter Dmax. That is, according to the exemplary embodiment, the grinding diameter, according to the size of the pressure of the coolant against the pressing portion 17*a* of the taper cone 17 (which is hereinafter referred to as the pressing force of the taper cone 17) varies within the range from the minimum diameter Dmin to the maximum diameter Dmax.

Here, since the honing operation is carried out using a general-purpose machine tool, it is assumed that the supply pressure of the coolant is constant. On this assumption, the pressing force of the taper cone 17 depends on the flow quantity of the coolant flowing out to the outside through the coolant flow-out hole 41 of the screw-like adjuster 15. This flow quantity depends on the diameter dimension (opening area) of the coolant flow-out hole 41.

Therefore, the pressing force of the taper cone 17 provides a size which corresponds to the diameter dimension of the coolant flow-out hole 41. That is, on the assumption that the supply pressure of the coolant is constant, the grinding diameter when expanded is determined uniquely according to the diameter dimension of the coolant flow-out hole 41.

Thus, for example, on the assumption that the supply pressure of the coolant is constant, there may be previously set a correspondence relationship between the grinding diameter when expanded and the diameter dimension of the coolant flow-out hole 41. In this case, according to the correspondence relationship, multiple screw-like adjusters 15, the coolant flow-out holes 41 of which are different from each other in the diameter dimensions thereof, can be manufactured easily and at low costs. This effect can be further enhanced in the case that the correspondence relationship is standardized.

Figures 6, 7:
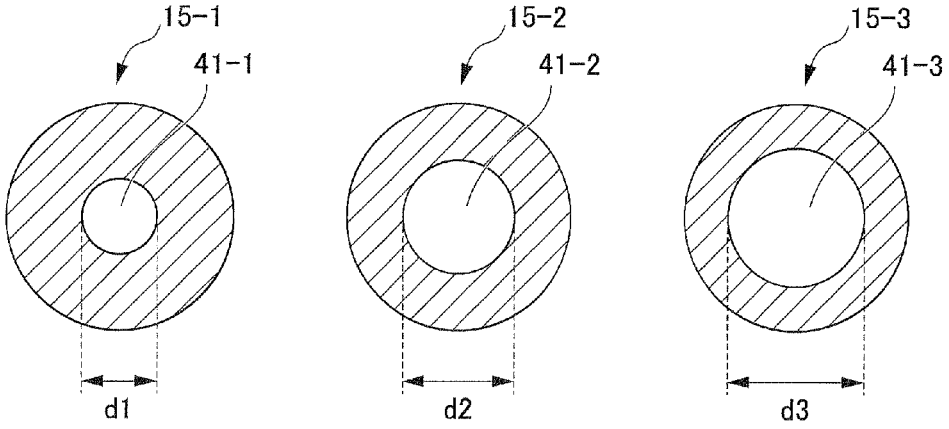
FIG. 6 is a view of an example of standards of diameter dimensions of the screw-like adjuster of the honing holder of the exemplary embodiment.
FIG. 7 is a bottom view of a screw-like adjuster based on the standards.

FIG. 6 is a view of an example of the standards of the diameter dimensions of the coolant flow-out hole 41.

In the standards of the example shown in FIG. 6, the grindstone diameters Dk when expanded (where k is one of integer values, that is, 1, 2 and 3) and the diameter dimensions dk of the coolant flow-out hole 41 are made to correspond to each other.

Here, in the standards of the example shown in FIG. 6, the diameter dimensions of the coolant flow-out hole 41 are set such that d1<d2<d3. Therefore, as the grinding diameters, there can be selected three kinds of diameters, D1>D2>D3.

FIG. 7 shows the lower surfaces of screw-like adjusters 15 based on the standards shown in FIG. 6.

As shown in FIG. 7, as the screw-like adjusters 15 based on the standards shown in FIG. 6, there exist a screw-like adjuster 15-1 including a coolant flow-out hole 41-1 having the smallest diameter d1, a screw-like adjuster 15-2 including a coolant flow-out hole 41-2 having the second smallest diameter d2, and a screw-like adjuster 15-3 including a coolant flow-out hole 41-3 having the largest diameter d3.

In this case, since the diameter dimension increases in order of the screw-like adjusters 15-1 to 15-3, it is possible to adjust or reduce the pressing force of the taper cone 17 according to this order. That is, there can be made an adjustment in which the grinding diameter is reduced according to this order.

Specifically, for example, in the case that the grinding diameter when expanded is adjusted to provide a diameter Dk, an operator may only carry out a simple operation: that is, the operator may select a screw-like adjuster 15-*k* and fit it into the screw hole of the main body 11.

Here, the standards shown in FIG. 6 are only an example and, in the case that an arbitrary number of arbitrary grinding diameters is defined, there can be set up various standards. Or, on the assumption that the supply pressure of the coolant is constant and the grinding diameter when expanded is constant, there may also be standardized a correspondence relationship between the surface pressure of the grindstone 31 against the inner surface of the hole of the workpiece and the diameter dimension of the coolant flow-out hole 41. As a result, a screw-like adjuster 15 including a coolant flow-out hole 41 having an arbitrary diameter dimension can be realized easily and at a low cost.

According to the exemplary embodiment, there can be obtained the following effects.

Specifically, (1): in order to move the taper cone 17 in the axial direction of the main body 11, there is provided the coolant flow passage 16 in such a manner that at least a part of the coolant is allowed to press the taper cone 17 in the axial direction and, in order to be able to adjust such pressing force, the remaining part of the coolant is allowed to flow out to the outside. Also, there is provided the screw-like adjuster 15 which can be removably fitted into the screw hole so formed as to penetrate through the coolant flow passage 16 and the outer periphery of the main body 11 and also which includes the coolant flow-out hole 41 capable of limiting the flow-out of the coolant to the outside. Thus, the adjustment of the pressing force of the taper cone 17 can be realized not by controlling the coolant supply pressure but by limiting the flow-out of the coolant to the outside according to the diameter dimension of the coolant flow-out hole 41. Therefore, for example, in the case that, in order to carry out multiple honing operations using a general-purpose machine tool providing a constant coolant supply pressure, there are prepared multiple screw-like adjusters 15 which are different from each other in the diameter dimension of the coolant flow-out hole 41, an operator is able to adjust the pressing force of the taper cone 17 easily simply by selecting a proper one from among the multiple screw-like adjusters 15 and fitting it into the screw hole of the main body 11. As a result, the grinding diameter can be easily expanded up to a desired diameter and also the surface pressure of the grindstone against the inner surface of the hole of the workpiece can be maintained at a proper pressure. Thus, when compared with a conventional technology in which the whole of the honing holder must be replaced, according to the exemplary embodiment, only the screw-like adjuster 15, which is a part of the honing holder, may be replaced, thereby being able to reduce the burden of the honing operation of the operator. Also, when compared with the conventional technology which needs to prepare multiple honing holders, according to the exemplary embodiment, there may be prepared only multiple screw-like adjusters 15 which are a part of the honing holder, thereby being able to reduce the cost of the honing holder.

(2): According to the exemplary embodiment, there can be prepared multiple screw-like adjusters 15-1 to 15-3 the coolant flow-out holes of which are different from each other in the diameter dimension thereof. Thus, the pressing force of the taper cone 17 can be adjusted not by controlling the supply pressure of the coolant but by replacing the screw-like adjusters 15-1 to 15-3 with each other. Also, for example, in the case that the supply pressure of the coolant is constant, there may be previously set (for example, standardized) the correspondence relationship between the grinding diameter when expanded the diameter dimension of the coolant flow-out hole 41. In this case, according to the correspondence relationship (standard), there can be provided easily and at a low cost multiple screw-like adjusters such as the multiple screw-like adjusters 15-1 to 15-3, the coolant flow-out holes 41-1 to 41-3 of which are different from each other in the diameter dimension thereof. Here, as described above, the number of kinds of screw-like adjusters 15 are not specially limited to three. That is, there can be provided similar effects to the above, provided that the number of kinds of multiple screw-like adjusters is two or more.

While description has been made in connection with specific exemplary embodiment of the invention, it will be obvious to those skilled in the art that various changes and modifications may be made therein without departing from the present invention.

For example, according to the exemplary embodiment, the diameters of the grinding shoe 13 and grindstone 31 can be expanded. However, this is not limitative. That is, instead of the grinding shoe 13, a given working portion may also be expanded.

Also, for example, according to the exemplary embodiment, the set of taper portions 17*b* and 13*b* and the set of taper portions 17*c* and 13*c* are adopted as a structure of the engagement of the taper cone 17 and the grinding shoe 13. However, this is not limitative, but the number of sets, the shape of the taper portions, the forming positions of the taper portions and the like can be set arbitrarily.

Further, for example, the coolant flow passage 16 may only be structured such that, in order to move the taper cone 17 in the axial direction of the main body 11, at least a part of the coolant can press the taper cone 17 in the axial direction and, in order to be able to adjust the pressing force of the taper cone 17, the part of the remaining coolant is allowed to flow out to the outside. The forming position of the coolant flow passage 16, the shape of the coolant flow passage 16 and the like are not specially limited to the exemplary embodiment.

DESCRIPTION OF REFERENCE NUMERALS AND SIGNS

1: Honing holder
11: main body
13: Grinding shoe
15: Screw-like adjuster
16: Coolant flow passage
17: Taper cone
41: Coolant flow-out hole

What is claimed is:

1. A tool holder comprising:

a main body including two end portions in an axial direction thereof, one of the two end portions being attachable to a spindle;

a taper cone including a taper portion and movable in the axial direction within the main body;

a working portion mounted on an outer peripheral portion of the other of the two end portions and including a taper bottom surface which engages with the taper portion, the taper bottom surface being movable in a radial direction of the main body based on a movement of the taper cone in the axial direction;

a coolant flow passage through which a coolant flows at a constant supply pressure, wherein a part of the coolant presses and moves the taper cone in the axial direction and another part of the coolant flows out to an outside so as to adjust a pressing force; and an adjuster removably fitted into a screw hole penetrating from the coolant flow passage to an outer periphery of the main body and including a coolant flow-out hole for adjusting a flow-out of the coolant to the outside.

2. The tool holder according to claim 1, wherein the adjuster includes multiple screw-like adjusters the coolant flow-out holes of which are different from each other in the diameter dimension thereof.

3. The tool holder of claim 1, wherein the coolant flow-out hole is disposed within the adjuster.

4. The tool holder of claim 1, wherein the coolant flow-out hole straightly penetrates through the adjuster.

5. The tool holder of claim 1, further comprising a spring that energizes the working portion inwardly in a radial direction.

6. A method of adjusting a grinding diameter of a tool holder, the tool holder including a main body, a taper cone accommodated within the main body, a working portion, and a coolant flow passage, the method comprising:

selecting one adjuster from a plurality of adjusters, the plurality of adjusters respectively including coolant flow-out holes and diameters of the coolant flow-out holes being different depending on the adjusters;

fitting the selected adjuster into a screw hole penetrating from the coolant flow passage to an outer periphery of the main body;

feeding a coolant to the coolant flow passage at a constant supply pressure, wherein a part of the coolant presses and moves the taper cone in an axial direction of the main body and another part of the coolant flows out to an outside through the coolant flow-out hole of the selected adjuster so as to adjust a pressing force; and moving the working portion in a radial direction of the main body based on a movement of the taper cone in the axial direction.

7. The method of claim 6, wherein the coolant flow-out holes are disposed within the plurality of adjusters.

8. The method of claim 6, wherein the coolant flow-out hole straightly penetrates through the adjuster.

9. The method of claim 6, further comprising energizing the working portion inwardly in a radial direction via a spring.

* * * * *